US005275032A

United States Patent [19]

Gloe et al.

[11] Patent Number: 5,275,032

[45] Date of Patent: Jan. 4, 1994

[54] METHOD AND APPARATUS FOR CONTROLLING THE CRIMP HEIGHT OF CRIMPED ELECTRICAL CONNECTIONS

[75] Inventors: Karl-Heinz Gloe, Reichelsheim; Michael Gerst, Worms; Helmuth Kreuzer, Munster, all of Fed. Rep. of Germany

[73] Assignee: The Whitaker Corporation, Wilmington, Del.

[21] Appl. No.: 876,826

[22] Filed: Apr. 29, 1992

Related U.S. Application Data

[63] Continuation of Ser. No. 706,627, May 29, 1991, abandoned.

[30] Foreign Application Priority Data

May 30, 1990 [GB] United Kingdom ..... 9012058

[51] Int. Cl.[5] ..... B21J 13/02

[52] U.S. Cl. ..... 72/19; 72/441; 72/446; 29/753

[58] Field of Search ..... 72/3, 19, 412, 413, 72/441, 446, 455, 9, 10, 12; 29/753, 863, 705

[56] References Cited

U.S. PATENT DOCUMENTS

| | | | |
|---|---|---|---|
| 3,184,950 | 5/1965 | Sitz | 29/753 |
| 3,190,319 | 6/1965 | Collins et al. | 72/412 |
| 3,398,567 | 8/1968 | Olsson | 72/413 |
| 4,400,873 | 8/1983 | Kindig et al. | 72/441 |
| 4,587,725 | 5/1986 | Ogawa et al. | 29/753 |
| 4,593,547 | 6/1986 | Heiberger | 72/19 |
| 4,790,173 | 12/1988 | Boutcher, Jr. | 72/413 |
| 4,856,186 | 8/1989 | Yeomans | 29/863 |
| 4,916,810 | 4/1990 | Yeomans | 29/753 |
| 4,970,889 | 11/1990 | Phillips et al. | 72/441 |
| 5,084,960 | 2/1992 | Yeomans | 29/753 |

FOREIGN PATENT DOCUMENTS

| | | | |
|---|---|---|---|
| 0184204 | 6/1986 | European Pat. Off. | 29/753 |
| 0279036 | 8/1988 | European Pat. Off. | 29/753 |

*Primary Examiner*—Lowell A. Larson
*Assistant Examiner*—Michael J. McKeon
*Attorney, Agent, or Firm*—Bruce J. Wolstoncroft

[57] ABSTRACT

The shut height of a crimping die set (9) for crimping an electrical terminal (T) on an anvil (22) to a lead (L) is adjustable stepwise by means of a disc (60) which can be driven by a servo motor (M1) to a plurality of angular positions each setting a theoretical ideal shut height for a particular combination of lead and terminal sizes. Since anvil wear, in particular, and/or minor variations in lead and terminal dimensions can falsify the ideal crimp height set, the actual crimp height achieved, is measured electronically or mechanically, and the height of the anvil (22) is automatically adjusted in accordance with such measurement, by means of a further servo motor (M2) to adjust the shut height of the die set (9) and anvil (22), so that the ideal shut height is achieved.

4 Claims, 6 Drawing Sheets

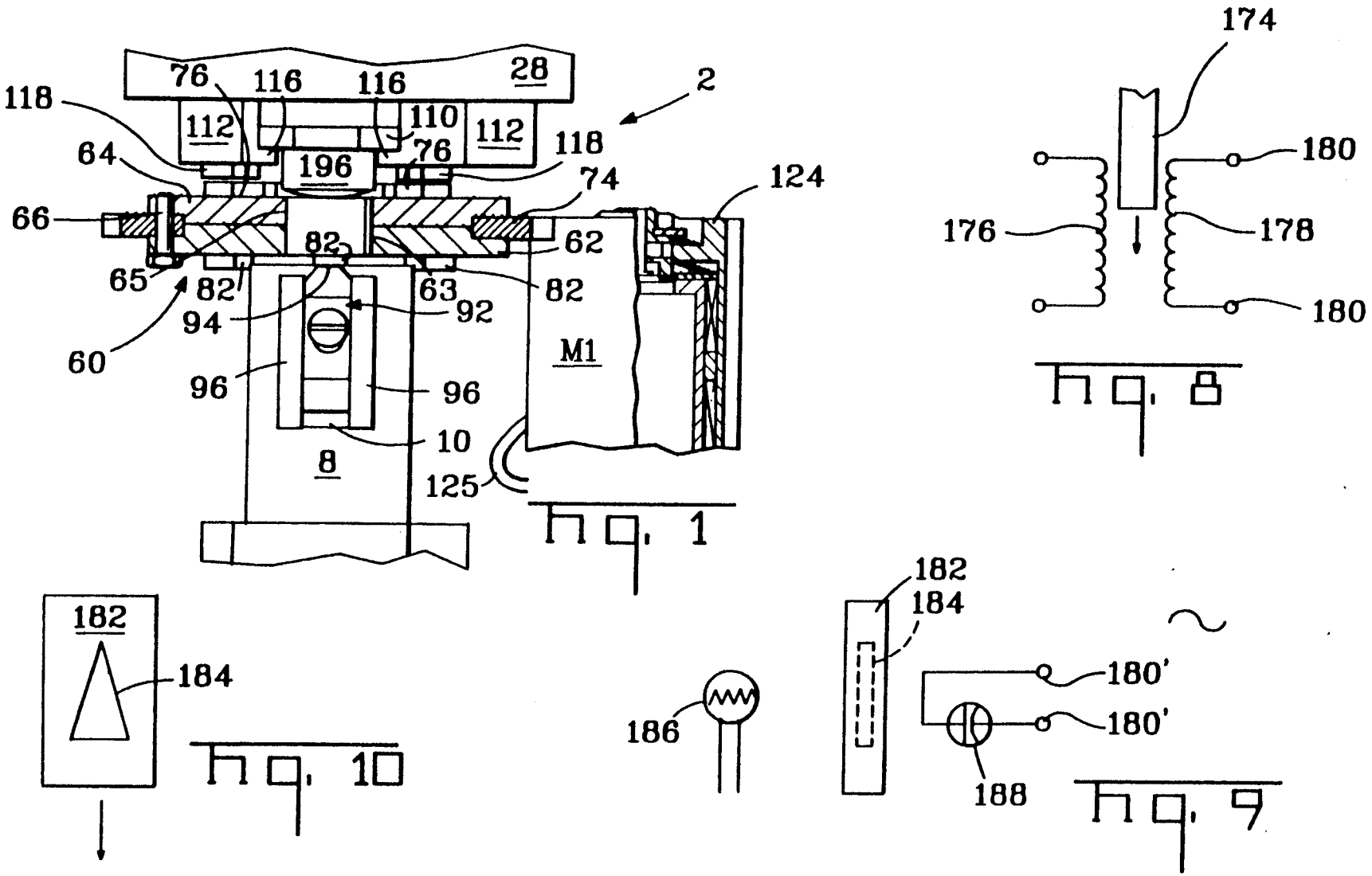
174
180
178
180
176
180'
180'
188
182
184
124
2
28
112
110
76
116
196
116
76
112
118
74
62
82
M1
92
63
96
10
125
82
8
94
96
82
65
60
64
66
118
186
184
182

METHOD AND APPARATUS FOR CONTROLLING THE CRIMP HEIGHT OF CRIMPED ELECTRICAL CONNECTIONS

This application is a continuation of application Ser. No. 07/706,627 filed May 29, 1991, now abandoned.

FIELD OF THE INVENTION

This invention relates to a method of, and apparatus for, controlling the crimp height of crimped electrical connections.

BACKGROUND OF THE INVENTION

There is disclosed in U.S. Pat. No. 3,184,950 a method of controlling the crimp height of crimped connections each produced by the application of a compressive crimping force to a crimping barrel of a respective electrical terminal, the method comprising the steps of coarsely adjusting the shut height of crimping tooling for crimping said barrels to electrical leads under said compressive force, to a theoretical value corresponding to an optimum crimp height for the crimped connections.

The said shut height is adjusted stepwise by means of a rotary disc having projections thereon each of a different height for selective intersection between an applicator ram carrying upper elements of the crimping tooling and a press ram for driving the applicator ram towards and away from lower crimping tooling. Each projection corresponds to the theoretical optimum crimp height for a particular terminal and lead size combination. These theoretical crimp heights are derived by testing the integrity of crimped connections produced by means of tooling, terminals and leads, which are in optimum condition. Thus in the event of tooling wear for example or minor variations in terminal or lead size, the crimped connections produced may be imperfect even if the disc be adjusted to its correct angular position for the terminal and lead combination to be used.

SUMMARY OF THE INVENTION

According to one aspect of the present invention, therefore, a method as defined in the second paragraph of this specification is characterized by the further steps of measuring the incremental values of the crimping force during its application; comparing said values with corresponding optimum values of the crimping force and automatically finely adjusting an element of said tooling in accordance with such comparison to bring the shut height thereof to said theoretical value.

According to another aspect of the present invention a method as defined in the second paragraph of this specification is characterized by the further steps of measuring the actual height of a crimped connection previously produced by means of said tooling under said compressive force, comparing such actual crimp height with said optimum crimp height and automatically finely adjusting an element of the crimping tooling in accordance with such comparison to bring the shut height thereof to said theoretical value.

With a method according to the invention thereof variations in tooling, terminal and lead dimensions are compensated for so that crimped connections of optimum integrity are produced.

According to a further aspect of the invention apparatus for crimping electrical terminals to electrical leads, the apparatus comprising a crimping die set; a crimping anvil; means for driving the die set through cycles of operation each comprising a working stroke towards the anvil and a return stroke away from the anvil; and means for adjusting the shut height of the die set stepwise to a theoretical value corresponding to the dimensions of the terminals and the leads; is characterized by means for determining, during operation of the apparatus, the actual value of said shut height; and means for automatically finely and continuously adjusting the height of said anvil to cause the value of said shut height to coincide with that of the theoretical shut height.

The adjustments of the said shut heights may be effected under the control of a microprocessor of the apparatus by means of servo electric motors. The apparatus may be fed with electrical leads by means of a conveyor and the means for determining the actual shut height may be a mechanical measuring device disposed downstream of the apparatus, in the conveying direction, means for measuring the gauges of the lead core and its insulation being disposed upstream of the apparatus, in the conveying direction.

The apparatus may be part of a lead making assembly comprising a plurality of crimping apparatus the microprocessors of which are under the control of a host computer which also controls the operation of the conveyor.

BRIEF DESCRIPTION OF THE DRAWINGS

For a better understanding of the invention and to show how it may be carried, into effect reference will now be made b example to the accompanying drawings, in which:

FIG. 1 is a fragmentary front view shown partly in section of the upper part of an applicator for crimping electrical terminals to stripped end portions of insulated electrical leads, the applicator comprising a rotary, crimp height adjustment plate;

FIG. 3 a is a somewhat enlarged view taken on the lines 3—3 of 2;

FIG. 8 is a diagram of one form of measuring means of said device;

FIG. 9 is a diagrammatic side view of another form of measuring means for said measuring device;

FIG. 10 is an elevational view of a detail of FIG. 9;

DETAILED DESCRIPTION OF THE INVENTION

Figures 2, 4, 7:
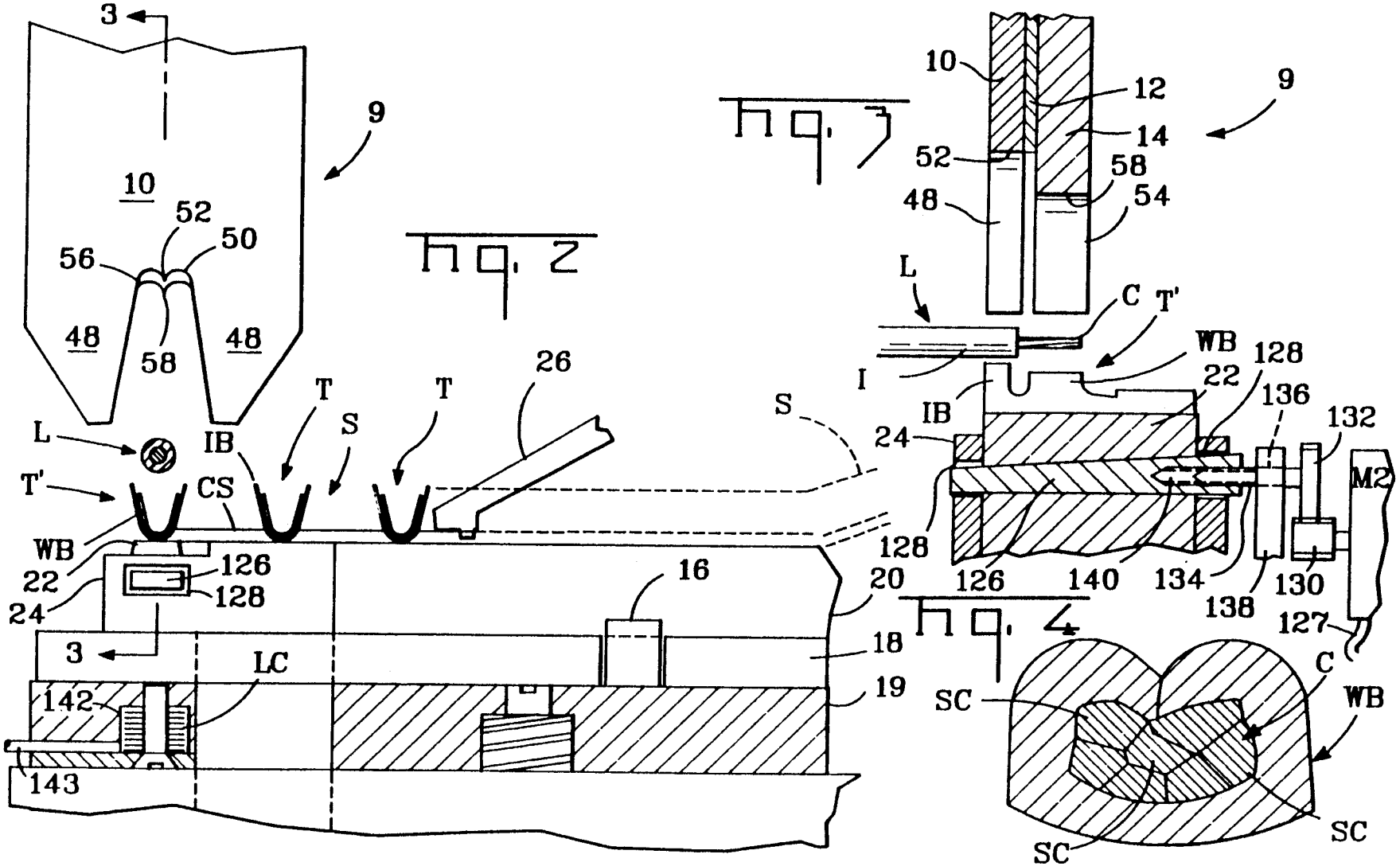
FIG. 2 is a fragmentary diagrammatic front view showing lower crimping tooling of the applicator and an electrical terminal feed assembly thereof.
FIG. 4 is a cross-sectional view through an electrical terminal which has been crimped to an electrical lead.
FIG. 7 is a partly diagrammatic fragmentary front view of a crimp measuring device.

As shown in FIG. 1 an electrical terminal applicator 2 comprises an applicator ram housing 6 in which is slidably received for vertical reciprocating motion an applicator ram 8. There extends from the ram 8, beneath the housing 6, a crimping die set 9 comprising an insulation barrel crimping die 10 and, juxtaposed therewith, with the interposition of a spacer plate 12, a wire barrel crimping die 14, as shown in FIGS. 2 and 3. The die 10 is positioned forwardly of the die 14. A mounting plate 18 is secured to a base portion 19 of a frame of the applicator 2 to which frame the ram housing 6 is also fixed, the plate 18 being secured to the base portion 19 by means of clips 16 (only one of which is shown). There is screwed to the plate 18, a terminal feed block 20 and a crimping anvil 22 mounted for vertical movement in a guide housing 24.

There is secured to the housing 6 a terminal strip feed assembly (not shown) for driving a terminal strip feed finger 26 to feed a strip S of electrical terminals T intermittently towards the anvil 22 to locate the leading terminal T' of the strip S on the anvil 22. Each terminal T comprises a U-section, open, insulation crimping barrel IB for crimping about the insulation I near the stripped end portion of an insulated electrical lead L, and a U-section, open, wire, crimping barrel WB for crimping about the bared end to the metal core C of the lead L.

Figure 11:
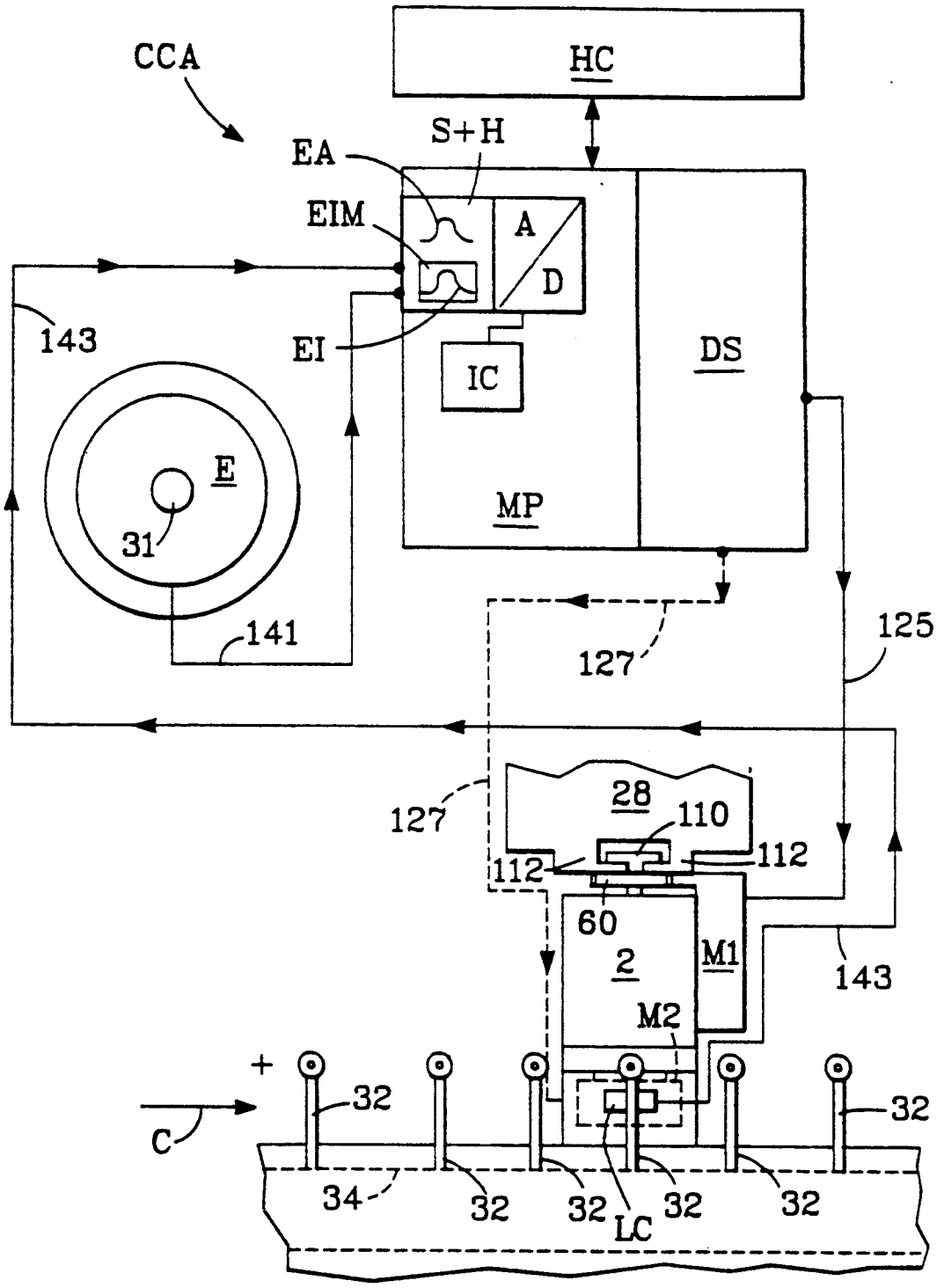
FIG. 11 is a schematic diagram partly in block form of a crimped connection quality control circuit arrangement according to a first embodiment, in association with the electrical terminal applicator.

A press ram 28 is driven by an electric drive motor (not shown), by way of an eccentric assembly 30 (FIG. 5) connected to the shaft 31 of the drive motor and comprising a drive shaft 33 driven by the shaft 31 by way of reduction gearing to drive the applicator ram 8 through a downward working stroke to crimp each terminal T when it is located on the anvil 22 to a lead L when it has been inserted between the die set 9 and the anvil 22, by means of jaws 32 (FIG. 11) carried by a conveyor 34, in a conveying direction C, from a lead measuring and stripping machine (not shown). After each crimping operation the press ram 28 raises the applicator ram 8 through a return stroke. During each crimping operation, the leading terminal T is sheared from a carrier strip CS connecting the terminals T, by means (not shown). As indicated in FIG. 11, the jaws 32 also move forwardly and rearwardly to insert the lead between the die set and the anvil and to withdraw the lead after the crimping operation.

The die 10 comprises a pair of spaced legs 48 diverging from arcuate forming surfaces 50 merging at a cusp 52, the die 14 having a pair of spaced legs 54 diverging from arcuate forming surfaces 56 merging at a cusp 58. Towards the end of the working stroke of the ram 8, the surfaces 50 of the die 10 curl over the upstanding ears of the wire barrel IB about the insulation of the lead L and drive them into the insulation, and the forming surfaces 56 of the die 14 curl over the upstanding ears of the wire barrel WB and wrap them over the core C to produce a cold forged crimped connection CC as shown in FIG. 4.

The insulation barrel IB when crimped to the insulation I acts as a strain relief device ensuring that if the lead L is tensioned when it is in use, the core C is not broken off near the crimped connection CC, at which position the core C will have been work hardened as a result of the crimping operation. If the crimp height, that is to say the shut height of the die 10 is too high in relation to the gauge of the insulation I, the crimped barrel IB will not grip the insulation sufficiently to afford the desired strain relief. Nevertheless, if the shut height of the die 10 is too low in relation to the insulation gauge, the crimped barrel IB will extrude the insulation I and ends of the ears of the barrel IB may be driven into the core C so as to impair its tensile strength.

If the shut height of the die 14 is too high in relation to the gauge of the core C, the strands ST of the core C will not be properly compressed into a voidless cold forged mass as shown in FIG. 4, so that the connection CC will be of low tensile strength. Nevertheless, if the shut height of the die 14 is too low in relation to the gauge of the core C, the strands ST may be broken off or unduly attenuated so that the connection CC is of low tensile strength in this case also.

For individual coarse adjustment of the crimp heights of the dies 10 and 14, the press ram 48 is coupled to the applicator ram by way of a rotary crimp height adjustment disc 60 (FIG. 1) which is indexable to a respective angular position to determine simultaneously the crimp heights for both the insulation barrel and the wire barrel. The disc 60 and its operation are described in detail in United Kingdom Patent Application No. 9012073.4 and the corresponding U.S. Pat. No. 5,095,599. The disc 60 comprises two superposed annular plates 62 and 64, respectively. The plates 62 and 64 have central bores 63 and 65, respectively, and are rigidly connected by means of screws 66. An annular gear wheel 74 is secured to the disc 60 by means of the screws 66. On the plate 64 is a ring of wire crimping die crimp height adjustment projections 76, of different heights surrounding the bore 65, the plate 62 having a ring of insulation crimping die crimp height adjustment projections 82 of different heights surrounding the bore 63. A tool holder 92 for the die 10 is vertically slidable between gibs 96 on the ram 8 and has an upper abutment surface 94 for selective engagement by the projections 82 according to the angular position of the disc 60. The die 14 is secured in a tool holder (not shown) at the lower end of the ram 46. An adaptor stud 96 having an adaptor head 110, and being fixed to the ram 8 extends through the bores 63 and 65. A pair of opposed claws 112 depending from the press ram 46 have flanges 116 engaging under the head 110, the underside of each claw 112 having thereon an abutment 118 for selective engagement by the projections 76 according to the angular position of the disc 60.

An electric motor M1 secured to the frame of the applicator 2 has an output shaft driving a gear wheel 124 meshing with the gear wheel 74. As explained below the motor M1 is responsive to angular position signals applied to an inlet lead 125 of the motor M1, to set the respective crimp heights of the dies 10 and 14 in response to each signal. The number of the projections 82 is a multiple of that of projections 76 so that more different crimp heights for the die 10, than for the die 14, can be selected, since leads L of a given core gauge may be of differing insulation gauge. Nevertheless, the projections 76 and 82 are so relatively dimensioned and arranged that in response to each signal, a plurality of settings for the die 14 can be selected for a given setting of the die 10, as explained in the patent application cited above. The crimp height adjustment is, however, stepwise in each case.

For fine and continuous adjustment of the said crimp heights, the anvil 22 is supported on a wedge 126 which is horizontally slidable in slots 128 in the housing 24 as best seen in FIG. 3, by means of an electric motor M2 behind the anvil 22. The motor M2 has an output shaft provided with an elongate gear wheel 130 meshing with a larger diameter but thinner gear wheel 132 on a screw threaded shaft 134 meshing with a tapped, through bore 136 in a plate 138 fixed to the applicator frame, and extending into a tapped, axial bore 140 in the wedge 126. As explained below, the motor M2 is responsive to crimping anvil fine adjustment signals applied to its inlet lead 127, to advance or withdraw the wedge 126 as the case may be.

A first embodiment of the crimped connection quality control circuit arrangement will now be described, with particular reference to FIGS. 2, 5, 6 and 11.

Snugly received in an opening 142 in the base portion 19 directly below the anvil 22, as shown in FIG. 2, is a piezoelectric load cell LC for continuously measuring a predetermined portion of the actual crimping force F during each crimping operation, the cell LC having an outlet lead 143. The output of the cell LC is proportional to the actual crimping force F as it is applied to the terminal T on the anvil 22 by the die set 9 during each crimping operation, during the end portion of the working stroke of the die set 9, and during the initial part of its return stroke. The shaft of the motor driving the press ram 28 drives an incremental encoder E (FIG. 5) having an outlead lead 141, the output of which is proportional to angular position of the shaft 33 and thus to the vertical position of the ram 48.

Figures 5, 6:
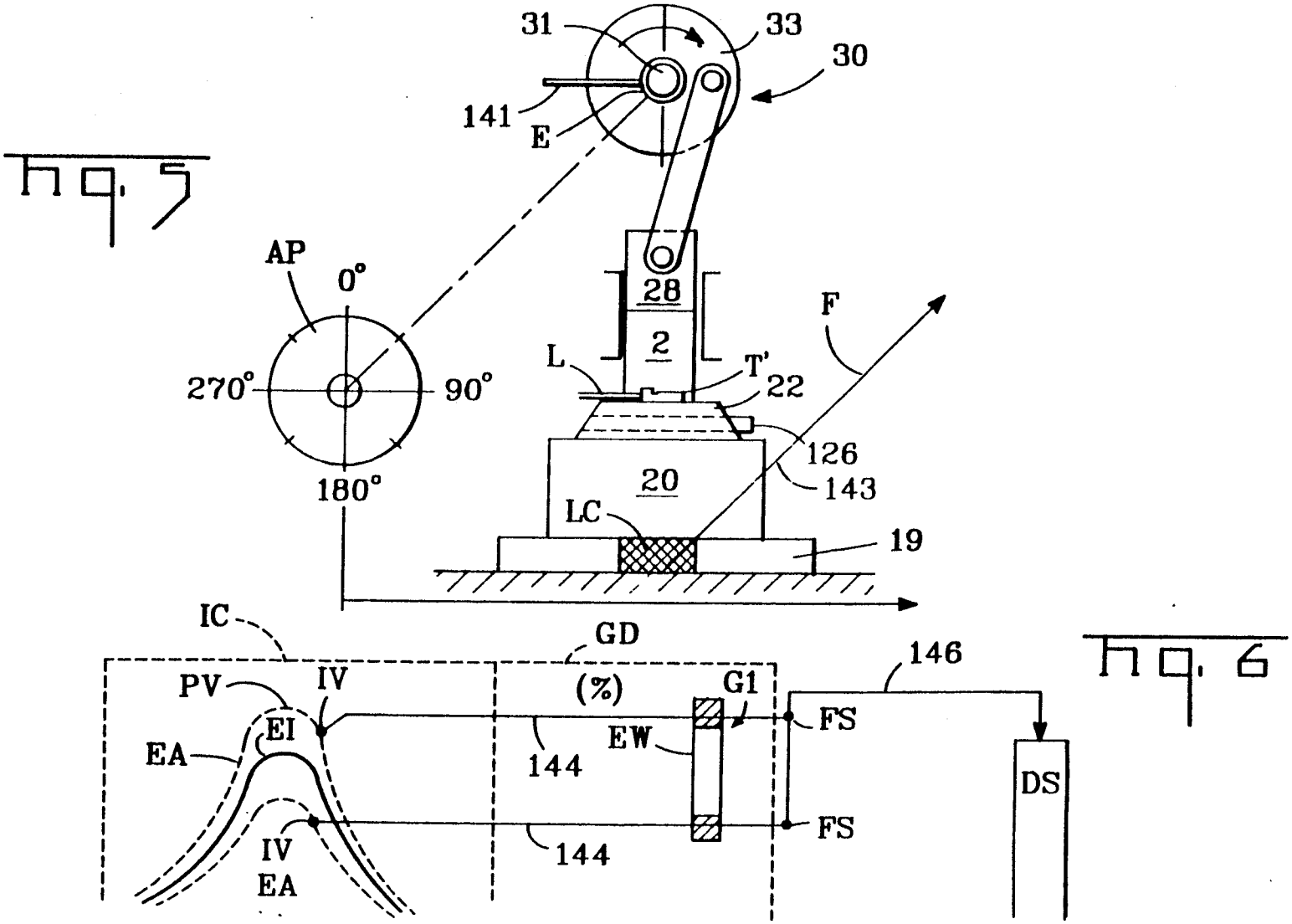
FIG. 5 is a theoretical diagram illustrating the measurement of the actual crimping force exerted on a terminal by the applicator, and a press ram arrangement for driving the FIG. 6 is a theoretical diagram illustrating means for determining a permissible threshold value of the actual crimping force in comparison with the corresponding value of an ideal crimping force envelope.
Figure 7:
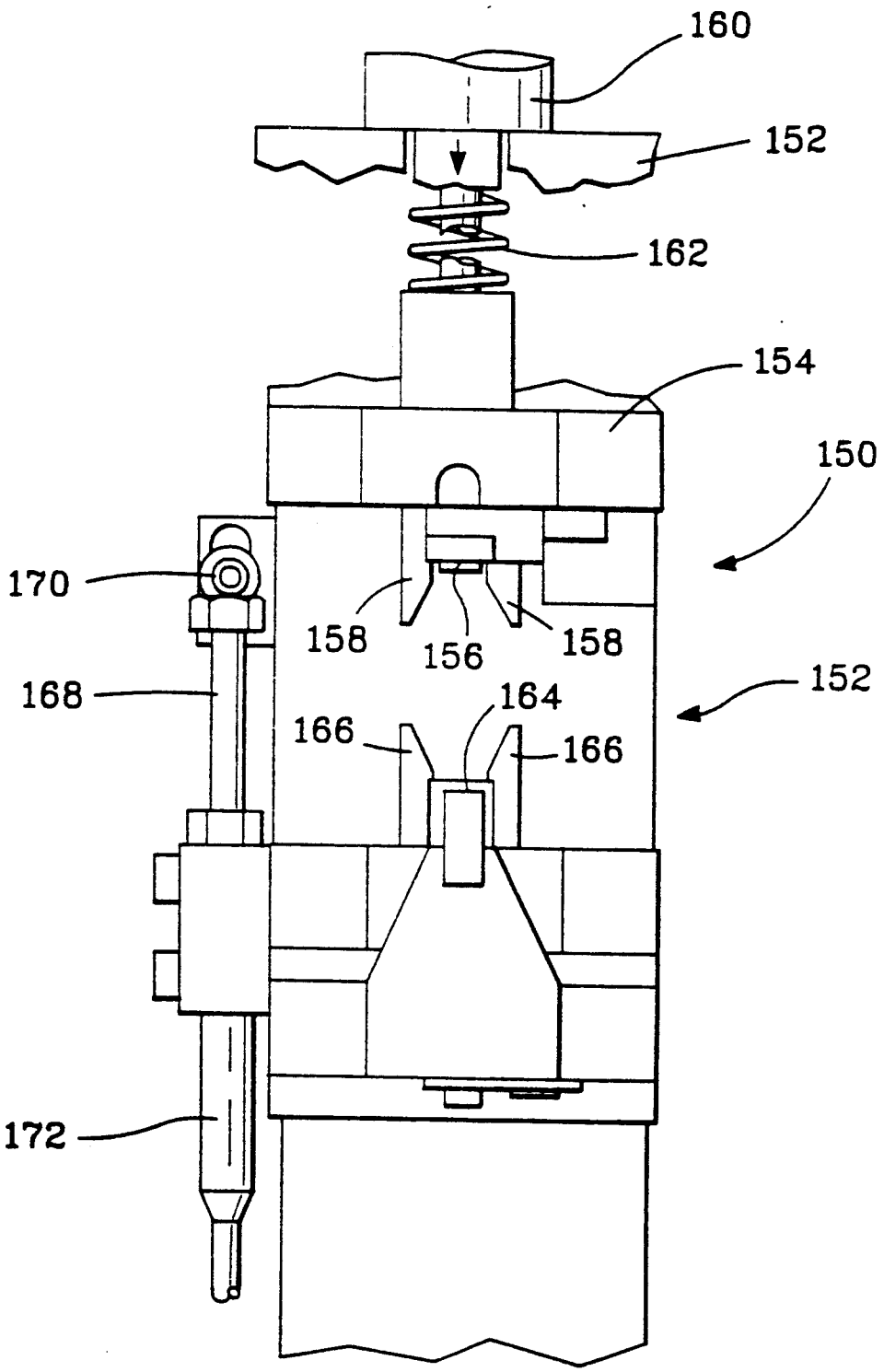

The theoretical diagrams of FIGS. 5 and 6 indicate how the encoder E cooperates with the load cell LC to produce an actual crimping force envelope EA (FIG. 6) by plotting the actual crimping force F applied by the die set 9 to the leading terminal T on the anvil 22, against an angular position AP of the drive shaft 33. This operation is described in greater detail in the United Kingdom Patent Application No. 8927467.4 (14684) which is incorporated herein by reference. The envelope EA, which is derived from the incremental values of the actual crimping force F, is generated within a measuring window over approximately 45° on either side of the bottom dead center position (180°) of the ram 28, that is to say the angular positions of the shaft 33 during which the die set 9 is in contact with the terminal T on the anvil 22, the peak value PV of the force F being attained at least proximate to said bottom dead center position of the ram 28. The envelope EA is entered in a sample and hold circuit S+H of a crimped connection quality control circuit arrangement CCA for the applicator 2 (FIG. 11) for comparison with an ideal, reference, crimping force envelope EI entered in an ideal envelope memory EIM. The envelope EIM is obtained by using an applicator of the same type as the applicator 2 which is in optimum condition, to crimp several terminals T, which are in optimum condition, to leads L of the correct core and insulation gauge for the terminals. The crimped connections are then inspected to ascertain that none of the connections between the leads and the terminals is faulty. If all of the crimped connections are good, the average of all of them is taken, to produce an average envelope, which is entered in the memory EIM as the envelope EI. Be it noted that both the dies and the anvil as well as the terminals, used in producing these optimum connections are always in optimum condition.

The circuit S+H and the memory EIM which are, as shown in FIG. 11, incorporated in a control microprocessor MP of the control circuit arrangement CCA, have their outlets connected by way of an analog-to-digital convertor A/D, to a comparator IC, also incorporated in the microprocessor MP, for comparing the incremental values IV of said actual crimping force with those of the ideal envelope EI. As shown in FIG. 6, the comparison effected by the comparator IC is applied to an outlet 144 which is connected to a gating device GD in the microprocessor MP, having gating means GI defining an evaluation window EW delimiting upper and lower thresholds for the signals emitted on the outlet 144. If a predetermined percentage of the signals occurring on the outlet 144 lies beyond either of the thresholds in respect of a cycle of operation of the applicator 2, the microprocessor MP emits a failure signal FS indicating that the actual crimping force F deviates to an extent requiring correction, above or below the ideal reference crimping force represented by the envelope EI. The signal FS is applied on a line 146 to a motor control drive system DS which applies on appropriate angular position signal to the inlet lead 125 of the motor M1, so as coarsely to adjust the actual crimp heights of the dies 10 and 14 of the applicator 2. If after the applicator 2 has carried out a predetermined number of further cycles of operation and the gating device GD continues to emit failure signals FS, the microprocessor MP actuates the drive system DS to cause the motor M2 either to advance or withdraw the wedge 126 according to the sense in which, and the extent to which, the signals FS indicate that the actual crimp height deviates from the ideal crimp height.

It should be noted that the crimp height set by means of the disc 60 is driven by the motor M1 may not coincide with the ideal crimping force as a result for example of anvil or die wear, bearing in mind that the envelope EI was produced with the use of leads and terminals of exactly correct dimensions and a die set and anvil in optimum condition.

Where a plurality of applicators 2 is automatically fed with stripped wires by means of the conveyor 34, the microprocessors MP of these applicators and the lead measuring and stripping machine may be controlled by means of a host computer HC connected to the microprocessor MP of each applicator 2 by a two-way line 146. The microprocessor of each applicator feeds the results of the comparisons made by the comparator IC to the host computer HC which can thereby monitor the quality of the crimped connections made thereby. If the computer HC receives failure signals from a microprocessor MP, the computer HC signals that microprocessor to correct the crimp heights of the applicator 2 concerned, in the manner described above.

A second embodiment of crimped connection quality control circuit arrangement CCAI will now be described with particular reference to FIGS. 7 to 10 and 12.

Figure 12:
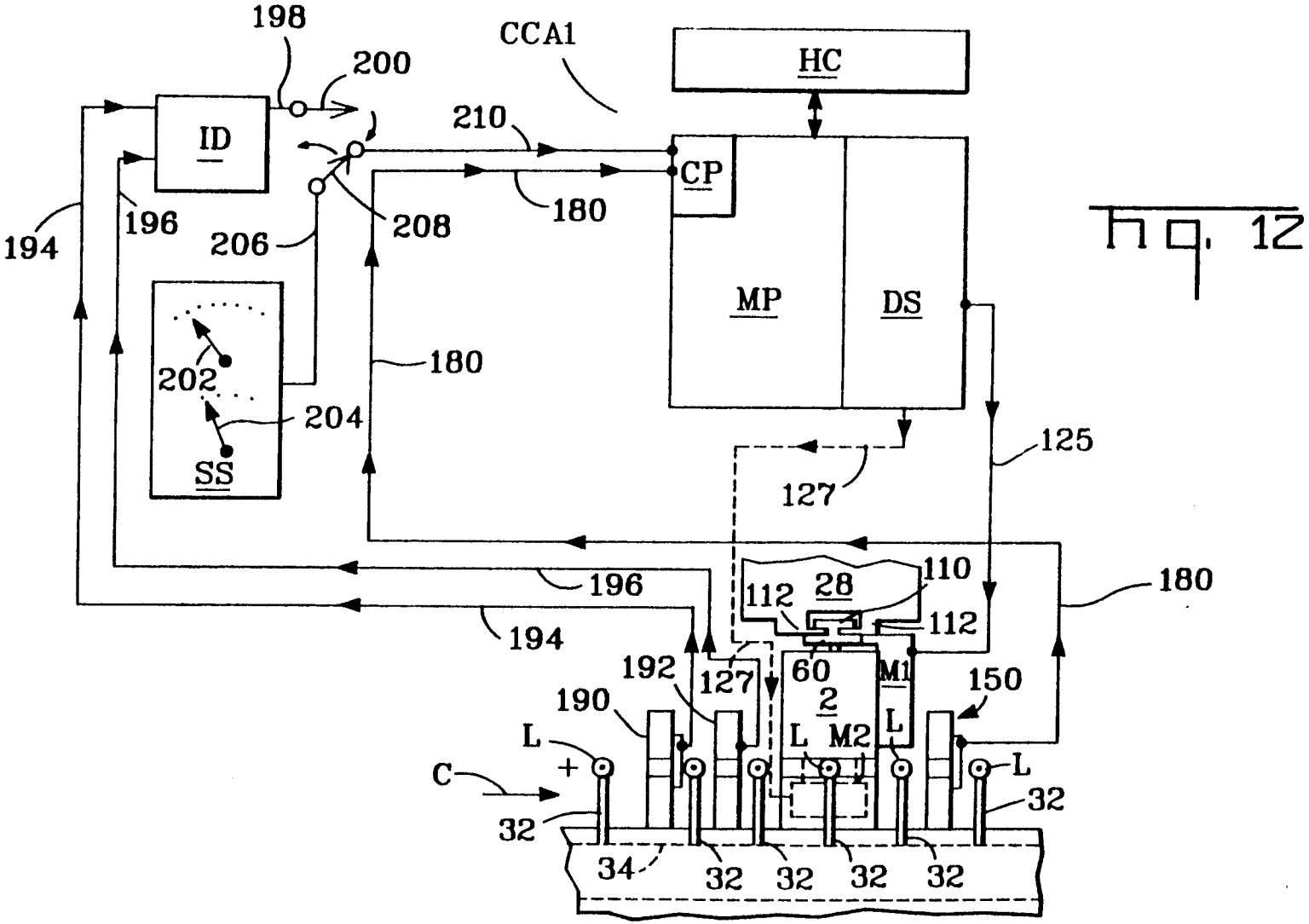
FIG. 12 is a schematic diagram partly in block form of a crimped connection quality control circuit arrangement according to a second embodiment, in association with the electrical terminal applicator.

As shown in FIG. 7, a crimp height measuring device 150 comprises a frame 152 having mounted for vertical reciprocating movement therein a plunger 154 having a terminal abutment 156 on either side of which are terminal guides 158. The plunger 154 is arranged to be driven in vertical reciprocating movement by means of a pneumatic piston and cylinder unit 160 on the frame 152, against the action of a spring 162, towards and away from a fixed abutment 164 on the frame 512, bounded by terminal guides 166. A piston 168 secured to the plunger 154 by means of a screw and slot connection 170, so as to be adjustable vertically, engages in a cylinder 172 fixed to the frame 152. There is secured to the lower end of the piston 168 a ferromagnetic core 174 (FIG. 8) which is movable with the piston 168 to alter the flux linkage between solenoids 176 and 178 in the cylinder 172. The coil 176 is continuously supplied with alternating current as indicated in FIG. 8, the coil 178 having outlet leads 180 connected to a comparator CP in microprocessor MP of the applicator 2. As shown in FIG. 12 the device 150 is positioned beside the applicator 2 downstream thereof in the conveying direction C of the conveyor 34. When a terminal T crimped to a lead L by the applicator 2 is placed on the abutment 164 by the jaw 32 grasping that lead L, a proximity switch (not shown) near the abutment 164 is actuated to cause the unit 160 to drive the abutment 156 against the crimped terminal T, the core 174 being accordingly simultaneously advanced so that a signal commensurate with the flux linkage between the coils 176 and 178 and being thus commensurate with the actual crimp height of the crimped terminal T appears at the outlet leads 180.

As an alternative (FIGS. 9 and 10) to the crimp height measuring means comprising the core 174 and coils 176 and 178, there may be fixed to the piston 168, a plate 182 having an upwardly tapered slot 184 therethrough in the form of a triangle, for interposition between a light source 186 and a photoelectric cell 188 in the cylinder, as the plunger 154 is advanced by the unit 160, so that the output on outlet leads 180' of the cell 188 is commensurate with the crimp height of the crimped terminal T.

There are disposed upstream of the applicator 2, as shown in FIG. 12, a lead core diameter measuring device 190 for measuring the gauge of the core C of each lead L and an insulation diameter measuring device 192 for measuring the gauge of the insulation I of each lead L. The devices 190 and 192 have outlet leads, 194 and 196, respectively, connected to an actual core and insulation gauge signal integrating device ID having an outlet line 198 connected to a switch 200.

The device 190 may be similar to the device 150, the device 192 having for example photoelectric means for measuring the insulation gauge, so that the insulation is not compressed so as to falsify the measurement of its diameter.

A manual switch system SS has a first manual switch 202 for setting an insulation gauge value and a second manual switch 204 for setting a core gauge value, the system SS having an outlet line 206 connected to a switch 208. Either of the switches 200 and 208 can be connected to an insulation gauge and core gauge signal inlet line 210 of the microprocessor MP, which is connected to a comparator CP therein. Prior to operation of the applicator 2, the switches 202 and 204 are set up manually, according to the expected gauges of the core and insulation of the leads L to be supplied to the applicator 2 and the size of the terminals T, the switch 208 being connected to the line 210, so that the microprocessor MP signals the drive system DS to cause the motor M1 to set the disc 60 to the required angular position coarsely to set the dies 10 and 14 to the theoretical crimp height for a predetermined lead and terminal size combination. The switch 200 is then connected to the line 210 and the switch 208 is disconnected therefrom.

The assembly comprising the lead stripping and measuring machine, the conveyor 34 and the applicator 2 is then started up. Signals corresponding to the actual core and insulation gauges measured by the devices 190 and 192 are fed to the microprocessor MP which accordingly signals the motor M1 to correct the crimp heights of the dies 10 and 14 should the core or insulation gauge of the leads L deviate from those set up by the switches 202 and 204.

This crimp height adjustment is also related to the theoretical crimp height that should be set in the case of predetermined lead and terminal sizes and, like the adjustments of the switches 202 and 204 is determined by testing for optimum crimp height with terminals and dies which are in optimum condition. In practice, terminal sizes may differ slightly from batch to batch of terminals and both die and anvil may be subject to wear so that their dimensions are altered. For this reason, the device 150, which measures the actual crimp heights of the finished connections between the leads L and the terminals T, is arranged to signal the actual crimp heights to the comparator CP of the microprocessor MP. If the measured, actual crimp heights of a predetermined number of crimped terminals T deviates from the theoretical crimp heights signalled by the switch system SS or the device ID and set by means of the disc 60, the comparator CP causes the microprocessor MP to signal the drive system DS to actuate the motor M2 to correct the vertical position of the anvil 22 so that the crimp heights coincide with the theoretical crimp heights, that is to say, the optimum crimp heights.

Where a plurality of applicators 2 is automatically fed by the jaws 32 as mentioned above with reference to FIG. 11, each microprocessor 2 feeds the information provided by the devices 150, 190 and 192, to the host computer HC, which thereby signals to microprocessors MP appropriately to control the crimp heights of all the applicators 2, in accordance with the information received by the host computer HC.

The applicator 2 could instead of being provided with the disc 60, be provided with separate discs, one for adjusting the shut height of the die 10 and the other for adjusting the shut height of the die 14, according to the teaching of U.S. Pat. No. 3,184,950 which is hereby incorporated herein by reference, a separate drive motor being provided for the adjustment of each disc, each drive motor actuable by means of a different signal from the drive system DS, or the switching system SS.

What is claimed is:

1. A method of controlling the crimp height of crimped connections each produced by the application of a compressive crimping force to a wire barrel portion and an insulation barrel portion of a crimping barrel of an electrical terminal connector, the method comprising the step of simultaneously coarsely adjusting the shut height both of the wire barrel portion crimping first upper die and an insulation barrel portion crimping second upper die of crimping tooling for crimping said barrels to electrical leads under said compressive force, to a theoretical value corresponding to an optimum crimp height for the crimped connections, by applying a single first signal corresponding to said optimum crimped height to a first electric motor to bring about stepwise adjustment of a single rotary member having rings of first projections of different heights and second projections of different heights for determining different vertical positions of, and being selectively engageable with, respective ones of said first and second upper dies of said crimping tooling, the ring of first projections being on one side of said rotary member and the ring of second projections being on the opposite side of said rotary member, the number of said second projections being a multiple of the number of said first projections and said projections being so relatively dimensioned and arranged that a plurality of adjustments for the second die can be selected for a given adjustment of the first die: said method comprising the further steps of plotting incremental values of the crimping force during its application against values representing the angular position of a rotating element driving said upper dies to produce an actual crimping force envelope, comparing said envelopes with corresponding optimum values of the crimping force and feeding a second signal corresponding to said comparison to a second electric motor to finely adjust a crimping anvil of said tooling in accordance with such comparison, to bring the shut height of said first and second upper dies of said tooling to said theoretical value.

2. Apparatus for crimping electrical terminals to electrical leads; the apparatus comprising a crimping die set; a crimping anvil; means for driving the die set through cycles of operation each comprising a working stroke towards the anvil and a return stroke away from the anvil; and a single first electric motor for adjusting the shut height of the die stepwise, to a theoretical value corresponding to the dimensions of the terminals and the leads; means for determining during operation of the apparatus, the actual value of said shut crimp height and a second electric motor for automatically finely and continuously adjusting the height of said anvil to cause the value of said actual shut height to coincide with the theoretical shut height; wherein said determining means comprises a load cell for measuring the value of the crimping force applied to each terminal and means for continuously measuring the position of the die set, during each cycle of operation of the apparatus, means for sampling and holding the results of said measurements to produce an actual crimping force value envelope, a comparator for comparing the actual envelope with an ideal crimping force envelope and means for producing a signal to actuate said second electric motor for adjusting the height of the anvil; and wherein said means for continuously measuring the position of the die set comprises an incremental encoder connected to a power driven shaft in driving relationship with said die set, for continuously supplying said sampling and holding means with signals representing the angular position of said shaft, said die set comprising a first die for crimping wire barrels of said electrical terminals to said leads and a second die for crimping insulation barrels of said terminals to said leads, said shut height adjusting means comprising a single rotary plate having a first side and second side opposite to said first side, a ring of first projections of different height on said first side for selective engagement with said first die and a ring of second projections of different heights on said second side for selective engagement with said second die, the number of said second projections being a multiple of the number of said first projections, said first and second projections being so relatively dimensioned and arranged that a plurality of adjustments for the second die can be selected for a given adjustment of the first die.

3. An electrical terminal applicator comprising an applicator ram driveable by means of a press ram through a working stroke towards, and a return stroke away from, a crimping anvil, the applicator ram having thereon a first crimping die for cooperation with the anvil to crimp a wire barrel of an electrical terminal to the bared end portion of the metal core of an insulated electrical lead during each stroke of the applicator ram, and a second crimping die for crimping an insulation barrel of the terminal to the insulation of the lead in cooperation with the anvil during said working stroke and said dies being adjustable lengthwise of the applicator ram, plate means being mounted for angular adjustment about an axis on, and extending lengthwise of, the applicator ram, selectively to interpose first projections of different heights between the press ram and the applicator ram to adjust the shut height of the first die and selectively to interpose second projections of different heights between the applicator ram and the second crimping die to adjust the shut height of that die, an electric motor being drivingly connected to said plate means for adjusting the angular position of said plate means about said axis; wherein said plate means is in the form of a single unit, the first projections being disposed on one side thereof and the second projections being disposed on the opposite side thereof, said single unit comprising an upper plate part and a lower plate part secured together in superposed relationship, said plate parts co-operating to define a peripheral recess receiving an annular gear wheel coaxial with said axis and meshing with a gear wheel driven by said motor; and wherein means are provided for determining the actual values of said shut heights, during the operation of the applicator as determined by the angular adjustment of said plate means, and means for automatically and continuously adjusting the height of said anvil to cause the actual values of said shut heights to coincide with theoretical shut heights of a value corresponding to the dimensions of the wire barrel and said lead.

4. Apparatus for crimping electrical terminals to leads, the apparatus comprising a first crimping die, a crimping anvil, rotary means for driving the die through cycles of operation each comprising a working stroke along a rectilinear path towards the anvil to crimp a terminal on the anvil to a lead, and a return stroke away from the anvil, means for stepwise adjustment of the shut height of the die to a theoretical value corresponding to the dimensions of the terminals and the leads, a load cell for measuring the value of the crimping force applied to a terminal during each cycle of operation, means for continuously measuring the angular position of the rotary member in turn to measure the position of the die along said rectilinear path during each cycle of operation, means for sampling and holding the results of both of said measurements to produce an actual crimping force value envelope, a comparator for comparing said actual crimping force value envelope with an ideal crimping force value envelope entered into said comparator, means for producing a signal indicative of the result of said comparison, and means for automatically and continuously adjusting the height of the anvil in response to said signal to cause the shut height of the die to coincide with said theoretical shut height, the apparatus further comprising a further crimping die driven by said rotary means, the shut height of the further crimping die driven by said rotary means being adjustable to a theoretical value corresponding to said dimensions by said stepwise adjustment means; wherein said stepwise adjustment means comprises a rotary unit having a first side and a second side opposite to said first side, first projections of different heights on said first side and second projections of different heights on said second side, said first projections being selectively engageable with said first die and said second projections being selectively engageable with said further die, whereby both of said dies can be simultaneously adjusted by rotation of said rotary unit, the number of the second projections being an integral multiple of the number of the first projections.

* * * * *